US010078282B2

(12) United States Patent
Sacripante et al.

(10) Patent No.: US 10,078,282 B2
(45) Date of Patent: Sep. 18, 2018

(54) TONER COMPOSITIONS AND PROCESSES

(71) Applicant: Xerox Corporation, Norwalk, CT (US)

(72) Inventors: Guerino G. Sacripante, Oakville (CA); Ke Zhou, Oakville (CA); Michael S. Hawkins, Cambridge (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 92 days.

(21) Appl. No.: 14/821,624

(22) Filed: Aug. 7, 2015

(65) Prior Publication Data

US 2017/0038696 A1 Feb. 9, 2017

(51) Int. Cl.

| | |
|---|---|
| ***G03G 9/087*** | (2006.01) |
| ***G03G 9/093*** | (2006.01) |
| ***G03G 9/08*** | (2006.01) |
| ***G03G 9/09*** | (2006.01) |

(52) U.S. Cl.

CPC ..... *G03G 9/08755* (2013.01); *G03G 9/081* (2013.01); *G03G 9/08782* (2013.01); *G03G 9/08797* (2013.01); *G03G 9/0904* (2013.01); *G03G 9/0935* (2013.01); *G03G 9/09307* (2013.01); *G03G 9/09328* (2013.01); *G03G 9/09335* (2013.01); *G03G 9/09371* (2013.01)

(58) Field of Classification Search

CPC ... G03G 9/08755; G03G 9/081; G03G 9/0904
See application file for complete search history.

(56) References Cited

U.S. PATENT DOCUMENTS

| | | | | |
|---|---|---|---|---|
| 5,856,386 | A | 1/1999 | Sakai et al. | |
| 6,291,122 | B1 | 9/2001 | Sacripante et al. | |
| 2010/0015544 | A1* | 1/2010 | Agur ..... | G03G 9/0804 430/108.23 |
| 2010/0173239 | A1* | 7/2010 | Iftime ..... | G03G 9/0806 430/107.1 |

* cited by examiner

*Primary Examiner* — Thorl Chea
(74) *Attorney, Agent, or Firm* — Eugene O. Palazzo

(57) ABSTRACT

Disclosed are toner compositions that include an amorphous polyester resin, a crystalline polyester resin, a colorant and a wax, and where the amorphous polyester resin contains in excess of zero weight percent of dodecylsuccinic anhydride to less than 16 weight percent of dodecylsuccinic anhydride, or where the amorphous polyester resin contains in excess of zero weight percent of dodecylsuccinic acid to less than 16 weight percent of dodecylsuccinic acid.

4 Claims, No Drawings

TONER COMPOSITIONS AND PROCESSES

The present disclosure is generally directed to toner compositions and processes thereof, and more specifically, to economical toners comprised of a single amorphous polyester resin, a crystalline polyester, colorant, optional wax, and optional additives, and which amorphous polyester resin is generated by the catalytic polymerization of monomers of, for example, a carboxylic acid, a dicarboxylic acid, a benzenetricarboxylic acid, at least one bisphenol, and a component selected from the group consisting of at least one of a dodecylsuccinic anhydride and a dodecylsuccinic acid, and wherein the amorphous polyester resin contains less than about 16 weight percent of the dodecylsuccinic anhydride.

BACKGROUND

A number of polyester containing toner compositions are known, including where the polyesters selected are specific amorphous, crystalline or mixtures thereof. Thus, for example, in U.S. Pat. No. 7,858,285, the disclosure of which is totally incorporated herein by reference, there are disclosed emulsion/aggregation toners that include certain crystalline polyesters.

Toner compositions prepared by a number of emulsion/aggregation processes, and which toners may include certain polyesters are known as disclosed in U.S. Pat. Nos. 8,466,254; 7,736,832; 7,029,817; 6,830,860, and 5,593,807, the disclosures of each of these patents being totally incorporated herein by reference.

While these known toners may be suitable for their intended purposes, there remains a need for toners with acceptable and improved characteristics relating, for example, to fixing temperature latitudes and blocking temperatures of, for example, a blocking temperature of from about 52° C. to about 60° C. There is also a need for polyester containing toners with excellent gloss, and improved cohesion and blocking temperature characteristics, acceptable minimum fixing temperatures, and excellent hot and cold offset temperatures, and which toners possess desirable size diameters. Further, there is a need for toner compositions that do not substantially transfer or offset onto a xerographic fuser roller, referred to as hot or cold offset depending on whether the temperature is below the fixing temperature of the paper (cold offset), or whether the toner offsets onto a fuser roller at a temperature above the fixing temperature of the toner (hot offset).

Also, there is a need for toners that can be economically prepared and where in place of two amorphous polyester resins of, for example, a terpoly-(propoxylated bisphenol A-terephthalate) terpoly-(propoxylated bisphenol A-dodecenylsuccinate) terpoly-(propoxylated bisphenol A-fumarate) (Comparative Example A, Table 1), and a terpoly-(propoxylated bisphenol A-terephthalate) terpoly-(propoxylated bisphenol A-dodecenylsuccinate)-terpoly-(ethoxylated bisphenol A-terephthalate) terpoly-(ethoxylated bisphenol A-dodecenylsuccinate)-terpoly-(propoxylated bisphenol A-trimellitate)-terpoly-(ethoxylated bisphenol A-trimellitate) (Comparative Example B), there is selected one amorphous polyester resin.

Additionally, there is a need for toner compositions comprised of a single economically based amorphous polyester generated from the use of certain amounts of the monomer dodecylsuccinic anhydride (DDSA), and where the plasticization, or compatibility with certain polyesters, such as the CPE 10:6 resin of poly(1,6-hexylene-1,12-dodecanoate), can be optimized to provide excellent and acceptable characteristics of fusing, cohesion (blocking), toner particle size, toner particle shape, resin glass transition temperatures, and triboelectric charging characteristics with, when desired, a reduced amount of wax component, and where the CPE 10:6 resin is poly(1,6-hexylene-1,12-dodecanoate), which resin can be generated by the reaction of dodecanedioc acid and 1,6-hexanediol.

Moreover, there is a need for toners and processes that enable the generation of economical polyesters.

There is also a need for toners that include a core of an amorphous polyester resin, a crystalline polyester resin, colorant, and wax, and a shell thereover of an amorphous polyester resin, wax, and colorant, and where the core and shell amorphous polyester resins can be generated with reduced amounts of the costly monomer dodecylsuccinic anhydride (DDSA).

Yet additionally, there is a need for polyester based toners with low fixing temperatures, such as from about 100° C. to about 130° C., and with a broad fusing latitude, such as from about 50° C. to about 90° C.

Another need resides in providing toners with improved blocking temperatures of, for example, at least about 52° C., such as from about 52° C. to about 59° C., from about 52° C. to about 55° C., and from about 52° C. to about 55° C.

Moreover, there is a need for toners with consistent small particle sizes of, for example, from about 1 to about 15 microns in average diameter, are of a suitable energy saving shape, have a narrow particle size GSD, and which toners include various core and shell structures.

These and other needs and advantages are achievable in embodiments with the processes and compositions disclosed herein.

SUMMARY

Disclosed is a toner composition comprised of an amorphous polyester resin, a crystalline polyester resin, a colorant and a wax, and which amorphous polyester is generated by the catalytic polymerization of monomers of a carboxylic acid, a dicarboxylic acid, a benzenetricarboxylic acid, at least one bisphenol and a component selected from the group consisting of at least one of dodecylsuccinic anhydride and dodecylsuccinic acid, and wherein the amorphous polyester resin contains from about 8 weight percent to about 15.9 weight percent of said component.

Further disclosed herein is a toner composition comprised of a core of an amorphous polyester resin, a crystalline polyester, a wax and a colorant, and at least one shell encasing said core, and which shell is comprised of an amorphous polyester resin, and optionally a wax, and which amorphous polyester for said core and said shell is generated by the catalytic polymerization of monomers of a carboxylic acid, a dicarboxylic acid, a benzenetricarboxylic acid, at least one bisphenol and a dodecylsuccinic anhydride or a dodecylsuccinic acid, and wherein said amorphous polyester resin contains in excess of zero percent of said dodecylsuccinic anhydride, or wherein said amorphous polyester resin contains in excess of zero percent of said dodecylsuccinic acid, and wherein said amorphous polyester contains less than 16 weight percent of said dodecylsuccinic acid, or wherein said amorphous polyester contains less than 16 weight percent of said dodecylsuccinic acid.

Moreover, there is illustrated herein a process comprising mixing an amorphous polyester resin, a crystalline polyester resin, a colorant, and a wax, and which amorphous polyester is generated by the catalytic polymerization of monomers of a carboxylic acid, a dicarboxylic acid, a benzenetricarboxylic acid, at least one bisphenol, and a compound selected from the group consisting of dodecylsuccinic anhydride and dodecylsuccinic acid, and wherein the amorphous polyester resin contains from about 8 weight percent to about 15.9 weight percent of said compound; and aggregating and coalescing to form toner particles.

EMBODIMENTS

The disclosed amorphous polyester resins can generally be prepared by a polycondensation process which involves reacting suitable organic diols and suitable organic diacids in the presence of polycondensation catalysts and dodecylsuccinic anhydride (DDSA), dodecylsuccinic acid, or mixtures thereof, and wherein embodiments reference herein to dodecylsuccinic anhydride (DDSA) also includes dodecylsuccinic acid.

There are disclosed herein toner compositions that comprise an amorphous polyester resin, at least one crystalline polyester resin, colorants, waxes, and optional additives. The toner compositions illustrated herein, which can be prepared by emulsion/aggregation/coalescence processes, comprise an economical single amorphous polyester resin, crystalline polyester, such as CPE 10:6 illustrated herein, wax, colorant, and toner additives.

In embodiments, the disclosed toners can be comprised of a core of, for example, a single amorphous polyester, a crystalline polyester, wax, colorant, and additives, and at least one shell thereover, such as from about 1 shell to about 5 shells, and more specifically, from about 1 shell to about 3 shells, and yet more specifically, from about 1 shell to about 2 shells.

Amorphous Polyesters

A number of amorphous polyesters, available from Kao Corporation, DIC Chemicals and Reichhold Chemicals, can be selected for the toners illustrated herein. Examples of amorphous polyesters, selected as a replacement for the prior art resin mixtures of a first resin of, for example, a terpoly-(propoxylated bisphenol A-terephthalate) terpoly-(propoxylated bisphenol A-dodecenylsuccinate) terpoly-(propoxylated bisphenol A-fumarate) (Comparative Example A), and a second resin of, for example, a terpoly-(propoxylated bisphenol A-terephthalate) terpoly-(propoxylated bisphenol A-dodecenylsuccinate)-terpoly-(ethoxylated bisphenol A-terephthalate) terpoly-(ethoxylated bisphenol A-dodecenylsuccinate)-terpoly-(propoxylated bisphenol A-trimellitate)-terpoly-(ethoxylated bisphenol A-trimellitate) (Comparative Example B), include poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), and terpoly(propoxylated bisphenol A-terephthalate)-terpoly(propoxylated bisphenol A-dodecenylsuccinate)-terpoly(propoxylated bisphenol A-fumarate), mixtures thereof, and the like.

The amorphous polyester resins can possess, for example, a number average molecular weight ($M_n$), as measured by gel permeation chromatography (GPC) of, for example, from about 5,000 to about 100,000, from about 10,000 to about 75,000, or from about 5,000 to about 50,000. The weight average molecular weight ($M_w$) of the amorphous polyester resins can be, for example, from about 2,000 to about 100,000, from about 15,000 to about 85,000, or from about 5,000 to about 80,000, as determined by GPC using polystyrene standards. The broad molecular weight distribution ($M_w/M_n$) or polydispersity of the amorphous polyester resin is, for example, from about 2 to about 8, from about 2 to about 6, and from about 3 to about 5.

The disclosed amorphous polyester resins can generally be prepared by a polycondensation process which involves reacting suitable organic diols and suitable organic diacids in the presence of polycondensation catalysts and anhydrides, such as dodecylsuccinic anhydride (DDSA). Generally, a stoichiometric equimolar ratio of an organic diol and an organic diacid is utilized, however, in some instances, wherein the boiling point of the organic diol is, for example, from about 180° C. to about 230° C., an excess amount of diol, such as ethylene glycol or propylene glycol, of from about 0.2 to 1 mole equivalent can be utilized and removed during the polycondensation process by distillation. The amount of catalyst utilized varies, and can be selected in amounts as disclosed herein, and more specifically, for example, from about 0.01 to about 1, or from about 0.1 to about 0.75 mole percent of the amorphous polyester resin.

Examples of organic diacids or diesters selected for the preparation of the amorphous polyester resins are as illustrated herein, and include fumaric, maleic, oxalic acid, succinic acid, glutaric acid, adipic acid, suberic acid, azelaic acid, sebacic acid, decanoic acid, 1,2-dodecanoic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid is selected in an amount of, for example, from about 48 to about 52 mole percent, or from about 1 to about 10 mole percent of the amorphous polyester resin.

Examples of organic diols, which include aliphatic diols that are utilized for the preparation of the disclosed amorphous polyester resins, and that may be included in the reaction mixture or added thereto, and which diols can be selected in an amount of, for example, from about 45 to about 55, or from about 48 to about 52 mole percent of the amorphous polyester, and with from about 2 to about 36 carbon atoms, are 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, alkylene glycols like ethylene glycol or propylene glycol, propoxylated bisphenol A and ethoxylated bisphenol A. The organic diol is selected in an amount of, for example, from about 48 to about 52 mole percent of the amorphous polyester resin.

In embodiments of the present disclosure the single amorphous polyester can be prepared from, and as a replacement for, the monomer combination of Comparative Examples A and B, as exemplified in Table 1 below, where the amount of dodecylsuccinic anhydride (DDSA) monomer is about 50 percent less than the sum total of the amounts listed, that is less than about 16 weight percent of the monomer dodecylsuccinic anhydride is utilized, from about 8 to about 15.9 weight percent, from about 8 to about 15 weight percent, from about 8 to about 13 weight percent, from about 9 to about 12.8 weight percent, or from about 9.5 to about 12.8 weight percent based on the solids, and where the Comparative Example A amorphous polyester product is terpoly-(propoxylated bisphenol A-terephthalate) terpoly- (propoxylated bisphenol A-dodecenylsuccinate) terpoly-(propoxylated bisphenol A-fumarate); and the Comparative Example B amorphous polyester product is terpoly-(propoxylated bisphenol A-terephthalate) terpoly-(propoxylated bisphenol A-dodecenylsuccinate)-terpoly-(ethoxylated bisphenol A-terephthalate) terpoly-(ethoxylated bisphenol A-dodecenylsuccinate)-terpoly-(propoxylated bisphenol A-trimellitate)-terpoly-(ethoxylated bisphenol A-trimellitate).

TABLE 1

| BPA IS BISPHENOL A | | |
|---|---|---|
| MONOMER | COMPARATIVE RESIN A (WEIGHT PERCENT) | COMPARATIVE RESIN B (WEIGHT PERCENT) |
| TEREPHTHALIC ACID | 16.8 | 30 |
| FUMARIC ACID | 7.8 | — |
| DODECYLSUCCINIC ANHYDRIDE | 11.1 | 21.5 |
| TRIMELLITIC ACID | — | 4.7 |
| PROPOXYLATED BPA | 64.3 | 3.5 |
| ETHOXYLATED BPA | — | 8.8 |

Bisphenols

A number of bisphenols can be selected for the preparation of the disclosed amorphous polyester resins, examples of which are alkoxyalkylated bisphenols, propoxylated BPA, ethoxylated BPA, 1,1-bis(4-hydroxyphenyl)-1-phenyl-ethane, 2,2-bis(4-hydroxyphenyl)hexafluoropropane, 2,2-bis(4-hydroxyphenyl) butane, bis-(4-hydroxyphenyl)diphenylmethane, 2,2-bis(3-methyl-4-hydroxyphenyl) propane, bis (4-hydroxyphenyl)-2,2-dichlorethylene, bis(4-hydroxyphenyl)-2,2-dichlorethylene, bis(4-hydroxyphenyl) methane, 2,2-bis(4-hydroxy-3-isopropyl-phenyl)propane, 1,3-bis(2-(4-hydroxyphenyl)-2-propyl)benzene, bis(4-hydroxyphenyl)sulfone, 1,4-bis(2-(4-hydroxyphenyl)-2-propyl)benzene, 5,5'-(1-methylethylidene)-bis[1,1'-(bisphenyl)-2-ol]propane, 1,1-bis(4-hydroxyphenyl)-cyclohexane, P-bisphenol A, which is 1,4-bis(2-(4-hydroxyphenyl)-2-propyl)benzene, E-bisphenol A, which is 1,1-bis(4-hydroxyphenyl)ethane, mixtures thereof, and the like, and where at least one bisphenol is, for example, from 1 to about 5 bisphenols, from 2 to about 4 bisphenols, from 1 to about 2 bisphenols, and 1 bisphenol.

Crystalline Polyesters

A number of crystalline polyesters can be selected for the disclosed toner compositions inclusive of suitable known crystalline polyesters. Specific examples of crystalline polyesters that may be selected for the disclosed toners are poly(1,6-hexylene-1,12-dodecanoate) (designation 10:6), poly(1,2-propylene-diethylene-terephthalate), poly(ethylene-terephthalate), poly(propylene-terephthalate), poly(butylene-terephthalate), poly(pentylene-terephthalate), poly (hexalene-terephthalate), poly(heptylene-terephthalate), poly(octylene-terephthalate), poly(ethylene-sebacate), poly (propylene-sebacate) (8:3), poly(butylene-sebacate) (8:4), poly(nonylene-sebacate) (8:9), poly(ethylene-adipate) (4:2), poly(propylene-adipate) (4:3), poly(butylene-adipate) (4:4), poly(pentylene-adipate) (4:4), poly(hexylene-adipate) (4:6), poly(heptylene-adipate) (4:7), poly(octylene-adipate) (1:8), poly(ethylene-glutarate) (1:2), poly(propylene-glutarate) (1:3), poly(butylene-glutarate) (1:4), poly(pentylene-glutarate) (1:5), poly(hexalene-glutarate) (1:6), poly(heptylene-glutarate) (1:7), poly(octylene-glutarate) (1:8), poly(ethylene-pimelate) (3:2), poly(propylene-pimelate) (3:3), poly (butylene-pimelate) (3:4), poly(pentylene-pimelate) (3:5), poly(hexalene-pimelate) (3:6), poly(heptadene-pimelate) (3:7), poly(1,2-propylene itaconate), poly(ethylene-succinate) (2:2), poly(propylene-succinate) (2:3), poly(butylene-succinate) (2:4), poly(pentylene-succinate) (3:5), poly(hexylene-succinate) (3:6), poly(octylene-succinate) (3:8), poly (decylene-decanoate) (8:10), poly(ethylene-decanoate) (8:2), poly(ethylene dodecanoate) (10:2), poly(nonylene-decanoate) (10:9), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), optionally mixtures thereof, and the like. A specific crystalline polyester selected for the disclosed toners is CPE 10:6, poly(1,6-hexylene-1,12-dodecanoate), which is generated by the reaction of dodecanedioc acid and 1,6-hexanediol, and more specifically, wherein the crystalline polyester is poly(1,6-hexylene-1,12-dodecanoate) of the following repeating formulas/structures

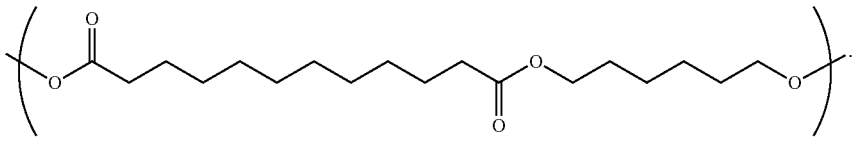

The crystalline resins can possess a number average molecular weight ($M_n$), as measured by gel permeation chromatography (GPC), of, for example, from about 1,000 to about 50,000, or from about 2,000 to about 25,000. The weight average molecular weight ($M_w$) of the crystalline polyester resins can be, for example, from about 2,000 to about 100,000, or from about 3,000 to about 80,000, as determined by GPC using polystyrene standards. The molecular weight distribution ($M_w/M_n$) of the crystalline polyester resin is, for example, from about 2 to about 6, and more specifically, from about 2 to about 4.

The disclosed crystalline polyester resins can be prepared by a polycondensation process by reacting suitable organic diols and suitable organic diacids in the presence of polycondensation catalysts. Generally, a stoichiometric equimolar ratio of organic diol and organic diacid is utilized, however, in some instances, wherein the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized varies, and can be selected in amounts, such as for example, from about 0.01 to about 1, or from about 0.1 to about 0.75 mole percent of the crystalline polyester resin.

Examples of organic diacids or diesters selected for the preparation of the crystalline polyester resins are as illustrated herein, and include fumaric, maleic, oxalic acid, succinic acid, glutaric acid, adipic acid, suberic acid, azelaic acid, sebacic acid, decanoic acid, 1,2-dodecanoic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid is selected in an amount of, for example, from about 48 to about 52 mole percent, of the crystalline polyester resin.

Examples of organic diols which include aliphatic diols selected in an amount of, for example, from about 1 to about 10, or from 3 to about 7 mole percent of the crystalline polyester resin that may be included in the reaction mixture or added thereto, and with from about 2 to about 36 carbon atoms, are 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, alkylene glycols like ethylene glycol or propylene glycol, and the like. The organic diols can be selected in various effective amounts, such as for example, from about 48 to about 52 mole percent of the crystalline polyester resin.

Examples of suitable polycondensation catalysts utilized for the preparation of the amorphous polyesters and crystalline polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, zinc acetate, titanium isopropoxide, butylstannoic acid available as FASCAT® 4100, or mixtures thereof; and which catalysts are selected in amounts of, for example, from about 0.01 mole percent to about 5 mole percent, from about 0.1 to about 0.8 mole percent, from about 0.2 to about 0.6 mole percent, or more specifically, about 0.2 mole percent, based, for example, on the starting diacid or diester used to generate the polyester resins.

For the toner compositions disclosed herein the amount of the amorphous polyester resin can be as illustrated herein, for example, from about 70 to about 90 percent by weight, from about 75 to about 85 percent by weight, or from about 70 to about 80 percent by weight with the amount of the crystalline polyester being, for example, from about 4 to about 15 percent by weight, from about 5 to about 12 percent by weight, or from about 7 to about 10 percent by weight, and the amounts of wax, colorant, and toner additives are as disclosed herein.

Waxes

Numerous suitable waxes may be selected for the toners illustrated herein, and which waxes can be included in the polyester resin containing mixture of the amorphous polyester and the crystalline polyester, in at least one shell, and in both the mixture and the at least one shell.

Examples of optional waxes included in the toner or on the toner surface include polyolefins, such as polypropylenes, polyethylenes, and the like, such as those commercially available from Allied Chemical and Baker Petrolite Corporation; wax emulsions available from Michaelman Inc. and the Daniels Products Company; EPOLENE N-15™ commercially available from Eastman Chemical Products, Inc.; VISCOL 550-P™, a low weight average molecular weight polypropylene available from Sanyo Kasei K.K.; OMNOVA D1509®, available from IGI Chemicals as a wax dispersion and similar materials. Examples of functionalized waxes that can be selected for the disclosed toners include amines, and amides of, for example, AQUA SUPERSLIP 6550™, SUPERSLIP 6530™ available from Micro Powder Inc.; fluorinated waxes, for example, POLYFLUO 190™, POLYFLUO 200™, POLYFLUO 523XF™, AQUA POLYFLUO 411™, AQUA POLYSILK 19™, POLYSILK 14™ available from Micro Powder Inc.; mixed fluorinated, amide waxes, for example, MICROSPERSION 19™ also available from Micro Powder Inc.; imides, esters, quaternary amines, carboxylic acids or acrylic polymer emulsion of, for example, JONCRYL 74™, 89™, 130™, 537™, and 538™, all available from SC Johnson Wax; chlorinated polypropylenes and polyethylenes available from Allied Chemical, Petrolite Corporation, and from SC Johnson Wax. A number of these disclosed waxes can optionally be fractionated or distilled to provide specific cuts or portions that meet viscosity and/or temperature criteria wherein the viscosity is, for example, about 10,000 cps, and the temperature is about 100° C.

In embodiments, the wax is in the form of a dispersion comprising, for example, a wax having a particle diameter of from about 100 nanometers to about 500 nanometers, or from about 100 nanometers to about 300 nanometers, water, and an anionic surfactant or a polymeric stabilizer, and optionally a nonionic surfactant. In embodiments, the wax comprises polyethylene wax particles, such as POLYWAX® 655, or POLYWAX® 725, POLYWAX® 850, POLYWAX® 500 (the POLYWAX® waxes being commercially available from Baker Petrolite) and, for example, fractionated/distilled waxes, which are distilled parts of commercial POLYWAX® 655 designated as X1214, X1240, X1242, X1244, and the like, but are not limited to POLYWAX® 655 cuts. Waxes providing a specific cut that meet the viscosity/temperature criteria, wherein the upper limit of viscosity is about 10,000 cps and the temperature upper limit is about 100° C., can be used. These waxes can have a particle diameter in the range of from about 100 to about 500 nanometers, although not limited to these diameters or sizes. Other wax examples include FT-100 waxes available from Shell (SMDA), and FNP0092 available from Nippon Seiro.

The surfactant used to disperse the wax can be an anionic surfactant, such as, for example, NEOGEN RK® commercially available from Daiichi Kogyo Seiyaku or TAYCAPOWER® BN2060 commercially available from Tayca Corporation, or DOWFAX® available from DuPont.

The toner wax amount can in embodiments be, for example, from about 0.1 to about 20 weight percent or percent by weight, from about 0.5 to about 15 weight percent, from about 1 to about 12 weight percent, from about 1 to about 10 weight percent, from about 2 to about 8 weight percent, from about 4 to about 9 weight percent, from about 1 to about 5 weight percent, from about 1 to about 4 weight percent, or from about 1 to about 3 weight percent based on the toner solids. The costs of the resulting toner can be decreased by adding a reduced amount of wax to the toner, to the toner surface, or both the toner and the toner surface, such as from about 4.5 weight percent to about 9 weight percent based on the solids.

Colorants

Examples of toner colorants include pigments, dyes, mixtures of pigments and dyes, mixtures of pigments, mixtures of dyes, and the like. In embodiments, the colorant comprises carbon black, magnetite, black, cyan, magenta, yellow, red, green, blue, brown, and mixtures thereof.

The toner colorant can be selected, for example, from cyan, magenta, yellow, or black pigment dispersions of each color in an anionic surfactant, or optionally in a non-ionic surfactant to provide, for example, pigment particles having a volume average particle diameter of, for example, from about 50 nanometers to about 300 nanometers, or from about 125 nanometers to about 200 nanometers. The surfactant used to disperse each colorant can be any number of known components such as, for example, an anionic surfactant like NEOGEN RK™. Known Ultimizer equipment can be used to provide the colorant dispersions, although media mills or other known processes can be utilized to generate the wax dispersions.

Toner colorant amounts vary, and can be, for example, from about 1 to about 50, from about 2 to about 40, from about 2 to about 30, from 1 to about 25, from 1 to about 18, from 1 to about 12, from 1 to about 6 weight percent, and from about 3 to about 10 percent by weight of total solids. When magnetite pigments are selected for the toner, the amounts thereof can be up to about 80 weight percent of solids like from about 40 to about 80 weight percent, or from about 50 to about 75 weight percent based on the total solids.

Specific toner colorants that may be selected include PALIOGEN VIOLET 5100™, and 5890™ (BASF), NORMANDY MAGENTA RD-2400™ (Paul Ulrich), PERMANENT VIOLET VT2645™ (Paul Ulrich), HELIOGEN GREEN L8730™ (BASF), ARGYLE GREEN XP-111-S™ (Paul Ulrich), BRILLIANT GREEN TONER GR 0991™ (Paul Ulrich), LITHOL SCARLET D3700™ (BASF), TOLUIDINE RED™ (Aldrich), Scarlet for THERMOPLAST NSD RED™ (Aldrich), LITHOL RUBINE TONER™ (Paul Ulrich), LITHOL SCARLET 4440™, NBD 3700™ (BASF), BON RED C™ (Dominion Color), ROYAL BRILLIANT RED RD-8192™ (Paul Ulrich), ORACET PINK RF™ (Ciba Geigy), PALIOGEN RED 3340™ and 3871™ (BASF), LITHOL FAST SCARLET L4300™ (BASF), HELIOGEN BLUE D6840™, D7080™, K7090™, K6910™ and L7020™ (BASF), SUDAN BLUE OS™ (BASF), NEOPEN BLUE FF4012™ (BASF), PV FAST BLUE B2G01™ (American Hoechst), IRGALITE BLUE BCA™ (Ciba Geigy), PALIOGEN BLUE 6470™ (BASF), SUDAN II™, III™ and IV™ (Matheson, Coleman, Bell), SUDAN ORANGE™ (Aldrich), SUDAN ORANGE 220™ (BASF), PALIOGEN ORANGE 3040™ (BASF), ORTHO ORANGE OR 2673™ (Paul Ulrich), PALIOGEN YELLOW 152™ and 1560™ (BASF), LITHOL FAST YELLOW 0991K™ (BASF), PALIOTOL YELLOW 1840™ (BASF), NOVAPERM YELLOW FGL™ (Hoechst), PERMANERIT YELLOW YE 0305™ (Paul Ulrich), LUMOGEN YELLOW D0790™ (BASF), SUCO-GELB 1250™ (BASF), SUCO-YELLOW D1355™ (BASF), SUCO FAST YELLOW D1165™, D1355™ and D1351™ (BASF), HOSTAPERM PINK E™ (Hoechst), FANAL PINK D4830™ (BASF), CINQUASIA MAGENTA™ (DuPont), PALIOGEN BLACK L9984™ (BASF), PIGMENT BLACK K801™ (BASF), and carbon blacks such as REGAL® 330 (Cabot), CARBON BLACK 5250™ and 5750™ (Columbian Chemicals), mixtures thereof, and the like.

Colorant examples include pigments present in water based dispersions, such as those commercially available from Sun Chemical, such as for example, SUNSPERSE BHD 6011™ (Blue 15 Type), SUNSPERSE BHD 9312™ (Pigment Blue 15), SUNSPERSE BHD 6000™ (Pigment Blue 15:3 74160), SUNSPERSE GHD 9600™ and GHD 6004™ (Pigment Green 7 74260), SUNSPERSE QHD 6040™ (Pigment Red 122), SUNSPERSE RHD 9668™ (Pigment Red 185), SUNSPERSE RHD 9365™ and 9504™ (Pigment Red 57), SUNSPERSE YHD 6005™ (Pigment Yellow 83), FLEXIVERSE YFD 4249™ (Pigment Yellow 17), SUNSPERSE YHD 6020™ and 6045™ (Pigment Yellow 74), SUNSPERSE YHD 600™ and 9604™ (Pigment Yellow 14), FLEXIVERSE LFD 4343™ and LFD 9736™ (Pigment Black 7), mixtures thereof, and the like. Water-based colorant dispersions that may be selected for the toner compositions disclosed herein include those commercially available from Clariant of, for example, HOSTAFINE Yellow GR™, HOSTAFINE Black T™ and Black T™, HOSTAFINE Blue B2G™, HOSTAFINE Rubine F6B™ and magenta dry pigment, such as Toner Magenta 6BVP2213 and Toner Magenta EO2, which pigments can also be dispersed in a mixture of water and surfactants.

Examples of toner pigments selected and available in the wet cake or concentrated form containing water can be easily dispersed in water utilizing a homogenizer, or simply by stirring, ball milling, attrition, or media milling. In other instances, pigments are available only in a dry form, whereby a dispersion in water is effected by microfluidizing using, for example, a M-110 microfluidizer or an Ultimizer, and passing the pigment dispersion from about 1 to about 10 times through the microfluidizer chamber, or by sonication, such as using a Branson 700 sonicator, or a homogenizer, ball milling, attrition, or media milling with the optional addition of dispersing agents such as the aforementioned ionic or nonionic surfactants.

Further, specific colorant examples are magnetites, such as Mobay magnetites MO8029™, MO8960™; Columbian magnetites, MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™ or TMB-104™; and the like, or mixtures thereof.

Specific additional examples of pigments present in the toner in an amount of from 1 to about 40, from 1 to about 20, or from about 3 to about 10 weight percent of total solids include phthalocyanine HELIOGEN BLUE L6900™, D6840™, D7080™, D7020™, PYLAM OIL BLUE™, PYLAM OIL YELLOW™, PIGMENT BLUE 1™ available from Paul Ulrich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK™ and cyan components, may also be selected as pigments. The pigment dispersion comprises pigment particles dispersed in an aqueous medium with an anionic dispersant/surfactant or a nonionic dispersant/surfactant, and wherein the dispersant/surfactant amount is in the range of from about 0.5 to about 10 percent by weight or from about 1 to about 7 percent by weight.

Toner Compositions

The toner compositions illustrated herein can be prepared by emulsion aggregation/coalescence methods as described in a number of patents inclusive, for example, of U.S. Pat. Nos. 5,593,807; 5,290,654; 5,308,734; 5,370,963; 6,120,967; 7,029,817; 7,736,832, and 8,466,254, the disclosures of each of these patents being totally incorporated herein by reference.

In embodiments, toner compositions may be prepared by any of the known emulsion-aggregation processes, such as a process that includes aggregating a mixture of an optional colorant, an optional wax and optional toner additives, with an emulsion comprising a single amorphous polyester resin and a crystalline polyester resin, aggregating, and then coalescing the aggregated mixture. The aforementioned resin mixture emulsion may be prepared by the known phase inversion process, such as by dissolving the amorphous polyester resin, and the crystalline polyester resin in a suitable solvent, followed by the addition of water like deionized water containing a stabilizer, and optionally a surfactant.

Examples of optional suitable stabilizers that are selected for the toner processes illustrated herein include aqueous ammonium hydroxide, water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. The stabilizer is typically present in amounts of, for example, from about 0.1 percent to about 5 percent, such as from about 0.5 percent to about 3 percent by weight, or weight percent of the colorant, wax and resin mixture. When salts are added as a stabilizer, it may be desirable in embodiments that incompatible metal salts are not present in the composition.

Suitable dissolving solvents utilized for the toner processes disclosed herein include alcohols, ketones, esters, ethers, chlorinated solvents, nitrogen containing solvents, and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. The resin mixture of the amorphous polyester and crystalline polyester can be dissolved in the solvent at elevated temperature of, for example, from about 40° C. to about 80° C., such as from about 50° C. to about 70° C. or from about 60° C. to about 65° C., with the desirable temperature in embodiments being lower than the glass transition temperature of the mixture of the wax and the amorphous polyester resin. In embodiments, the resin mixture is dissolved in the solvent at elevated temperature, but below the boiling point of the solvent, such as from about 2° C. to about 15° C. or from about 5° C. to about 10° C. below the boiling point of the solvent.

Optionally, an additional stabilizer, such as a surfactant, may be added to the disclosed aqueous emulsion medium to afford additional stabilization to the resin mixture. Suitable surfactants include anionic, cationic and nonionic surfactants. In embodiments, the use of anionic and nonionic surfactants can additionally help stabilize the aggregation process in the presence of the coagulant.

Anionic surfactant examples include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN® brand of anionic surfactants. An example of a suitable anionic surfactant is NEOGEN® R-K available from Daiichi Kogyo Seiyaku Co. Ltd. (Japan), or TAYCAPOWER® BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL® and ALKAQUAT®, available from Alkaril Chemical Company, SANISOL® (benzalkonium chloride), available from Kao Chemicals, and the like. An example of a suitable cationic surfactant is SANISOL® B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc Inc. as IGEPAL® CA-210, IGEPAL® CA-520, IGEPAL® CA-720, IGEPAL® CO-890, IGEPAL® CG-720, IGEPAL® CO-290, ANTAROX® 890 and ANTAROX® 897. An example of a suitable nonionic surfactant is ANTAROX® 897 available from Rhone-Poulenc Inc., and which consists primarily of alkyl phenol ethoxylate.

Thus, there can be accomplished with the use of a homogenizer the blending and aggregation of the mixture of the crystalline polyester resin emulsion and the amorphous polyester resin in the presence of a colorant, and optionally a wax with an aggregating agent, such as aluminum sulfate, at a pH of, for example, from about 3 to about 5. The temperature of the resulting blend may be slowly raised to about 40° C. to about 65° C., or from about 35° C. to about 45° C., and held there for from about 3 hours to about 9 hours, such as about 6 hours, in order to provide, for example, from about 2 to about 15 microns or from about 3 microns to about 5 microns diameter aggregated particles, followed by the addition of the disclosed amorphous polyester emulsion, and optionally a wax emulsion to form a shell, and wherein the aggregated particle size increases to from about 4 microns to about 7 microns, followed by optionally adding more amorphous polyester emulsion for a second shell together with optionally a wax emulsion. The final aggregated particles mixture can then be neutralized with an aqueous sodium hydroxide solution or buffer solution to a pH of, for example, from about a pH of 8 to about a pH of about 9. The aggregated particles are then heated from about 50° C. to about 90° C., causing the particles to be coalesced into toner composites with particle sizes in average volume diameter of, for example, from about 1 to about 15 microns or from about 5 to about 7 microns, and with an excellent shape factor of, for example, of from about 105 to about 170, from about 110 to about 160, or from about 115 to about 130 as measured on the FPIA SYSMEX analyzer or by scanning electron microscopy (SEM) and image analysis (IA).

With further regard to the emulsion/aggregation/coalescence processes, following aggregation, the aggregates are coalesced as illustrated herein. Coalescence may be accomplished by heating the disclosed resulting aggregate mixture to a temperature that is about 5° C. to about 30° C. above the Tg of the amorphous resin. Generally, the aggregated mixture can be heated to a temperature of from about 50° C. to about 95° C. or from about 75° C. to about 90° C. In embodiments, during heating the aggregated mixture may also be stirred by an agitator having blades rotating at from about 200 to about 750 revolutions per minute to help with the coalescence of the particles, and where coalescence may be accomplished over a period of, for example, from about 3 to about 9 hours.

Optionally, during coalescence the particles may be controlled by adjusting the pH of the mixture obtained. Generally, to control the particle size, the pH of the mixture can be adjusted to from about 5 to about 8 using a base such as, for example, sodium hydroxide.

After coalescence, the mixture may be cooled to room temperature, about 25° C., and the toner particles generated may be washed with water and then dried. Drying may be accomplished by any suitable method including freeze drying, which is usually accomplished at temperatures of about −80° C. for a period of about 72 hours.

Subsequent to aggregation and coalescence, the toner particles in embodiments have a volume average particle diameter as illustrated herein, and of from about 1 to about 15 microns, from about 4 to about 15 microns, or from about 6 to about 11 microns, such as about 7 microns as determined by a Coulter Counter. The volume geometric size distribution ($GSD_V$) of the toner particles may be in a range of from about 1.20 to about 1.35, and in embodiments less than about 1.25 as determined by a Coulter Counter.

Moreover, in embodiments of the present disclosure a pre-toner mixture can be prepared by combining a colorant, and optionally a wax and other toner components, stabilizer, surfactant, and both the disclosed crystalline polyester and the disclosed amorphous polyester into an emulsion, or a plurality of emulsions. In embodiments, the pH of the pre-toner mixture can be adjusted to from about 2.5 to about 4 by an acid such as, for example, acetic acid, nitric acid or the like. Additionally, in embodiments, the pre-toner mixture optionally may be homogenized. When the pre-toner mixture is homogenized, homogenization thereof may be accomplished by mixing at, for example, from about 600 to about 4,000 revolutions per minute with, for example, a TKA ULTRA TURRAX T50 probe homogenizer.

Following the preparation of the pre-toner mixture, an aggregate mixture is formed by adding an aggregating agent (coagulant) to the pre-toner mixture. The aggregating agent is generally comprised of an aqueous solution of a divalent cation or a multivalent cation containing material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature (Tg) of the amorphous polyester containing emulsion. In some embodiments, the aggregating agent may be added in an amount of from about 0.05 to about 3 parts per hundred (pph) and from about 1 to about 10 pph (parts per hundred) with respect to the weight of toner. The aggregating agent may be added to the pre-toner mixture over a period of from about 0 to about 60 minutes, and where aggregation may be accomplished with or without maintaining homogenization.

More specifically, in embodiments the toners of the present disclosure can be prepared by emulsion/aggregation/coalescence by (i) generating or providing a latex emulsion containing a mixture of an amorphous polyester resin, a crystalline polyester resin, water, and surfactants, and generating or providing a colorant dispersion containing colorant, water, and an ionic surfactant, or a nonionic surfactant; (ii) blending the latex emulsions with the colorant dispersion and optional additives, such as a wax; (iii) adding to the resulting blend a coagulant comprising a polymetal ion coagulant, a metal ion coagulant, a polymetal halide coagulant, a metal halide coagulant, or a mixture thereof; (iv) aggregating by heating the resulting mixture below or about equal to the glass transition temperature (Tg) of the amorphous polyester resin to form a core; (v) optionally adding a further latex comprised of the amorphous polyester resin emulsion and optionally a wax emulsion resulting in a shell; (vi) introducing a sodium hydroxide solution to increase the pH of the mixture to about 4, followed by the addition of a sequestering agent to partially remove coagulant metal from the aggregated toner in a controlled manner; (vii) heating the resulting mixture of (vi) about equal to or about above the Tg (glass transition temperature) of the amorphous resins mixture at a pH of from about 7 to about 9; (viii) maintaining the heating step until the fusion or coalescence of resins and colorant are initiated; (ix) changing the pH of the above (viii) mixture to arrive at a pH of from about 6 to about 7.5 thereby accelerating the fusion or the coalescence, and resulting in toner particles comprised of the amorphous polyester, the crystalline polyester, wax, and colorant; and (x) optionally, isolating the toner.

In the above disclosed specific toner emulsion/aggregation/coalescence processes, to assist in controlling the aggregation and coalescence of the particles, the aggregating agent can, if desired, be metered into the resin containing mixture selected over a period of time. For example, the aggregating agent can be metered into the resin containing mixture over a period of, in one embodiment, at least from about 5 minutes to about 240 minutes, from about 5 to about 200 minutes, from about 10 to about 100 minutes, from about 15 to about 50 minutes, or from about 5 to about 30 minutes. The addition of the aggregating agent or additive can also be performed while the mixture is maintained under stirred conditions of from about 50 rpm (revolutions per minute) to about 1,000 rpm, or from about 100 rpm to about 500 rpm, although the mixing speed can be outside of these ranges, and at a temperature that is below the glass transition temperature of the amorphous polyester resin of, for example, about 100° C., from about 10° C. to about 50° C., or from about 35° C. to about 45° C. although the temperature can be outside of these ranges.

The particles formed can be permitted to aggregate until a predetermined desired particle size is obtained, and where the particle size is monitored during the growth process until the desired or predetermined particle size is achieved. Composition samples can be removed during the growth process and analyzed, for example, with a Coulter Counter to determine and measure the average particle size. Aggregation can thus proceed by maintaining the elevated temperature, or by slowly raising the temperature to, for example, from about 35° C. to about 100° C. (although the temperature may be outside of this range), or from about 35° C. to about 45° C., and retaining the mixture resulting at this temperature for a time period of, for example, from about 0.5 hour to about 6 hours, and in embodiments of from about 1 hour to about 5 hours (although time periods outside of these ranges can be used) while maintaining stirring to provide the aggregated particles. Once the predetermined desired particle size is reached, the growth process is halted.

When the desired final size of the toner particles is achieved, the pH of the mixture can be adjusted with a base to a value, in one embodiment, of from about 6 to about 10, and in another embodiment of from about 6.2 to about 7, although a pH outside of these ranges can be used. The adjustment of the pH can be used to freeze, that is to stop toner particle growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts of from about 2 to about 25 percent by weight of the mixture, and in more specific embodiments, from about 4 to about 10 percent by weight of the mixture, although amounts outside of these ranges can be used.

Following aggregation to the desired particle size, the particles can then be coalesced to the desired size and final shape, the coalescence being achieved by, for example, heating the resulting mixture to any desired or effective temperature of from about 55° C. to about 100° C., from about 75° C. to about 90° C., from about 65° C. to about 75° C., or about 75° C., although temperatures outside of these ranges can be used, which temperatures can be below the melting point of the crystalline resin to prevent or minimize plasticization. Higher or lower temperatures than those disclosed may be used for coalescence, it being noted that this temperature can be, for example, related to the toner components selected, such as the resins and resin mixtures, waxes, and colorants.

Coalescence can proceed and be performed over any desired or effective period of time, such as from about 0.1 hour to about 10 hours, from about 0.5 hour to about 8 hours, or about 4 hours, although periods of time outside of these ranges can be used.

After coalescence, the disclosed mixture can be cooled to room temperature, typically from about 20° C. to about 25° C. (although temperatures outside of this range can be used). The cooling can be rapid or slow, as desired. A suitable cooling method can include introducing cold water to a jacket around the reactor containing the individual toner components. After cooling, the toner particles can be optionally washed with water and then dried. Drying can be accomplished by any suitable method including, for example, freeze drying resulting in toner particles possessing a relatively narrow particle size distribution with a lower number ratio geometric standard deviation (GSDn) of from about 1.15 to about 1.40, from about 1.18 to about 1.25, from about 1.20 to about 1.35, or from 1.25 to about 1.35.

The toner particles prepared in accordance with the present disclosure can, in embodiments, have a volume average diameter as disclosed herein (also referred to as "volume average particle diameter" or "D50v"), and more specifically, the volume average diameter can be from about 1 to about 25, from about 1 to about 15, from about 1 to about 10, or from about 2 to about 5 microns. D50v, GSDv, and GSDn can be determined by using a measuring instrument, such as a Beckman Coulter Multisizer 3, operated in accordance with the manufacturer's instructions. Representative sampling can occur as follows. A small amount of the toner sample, about 1 gram, can be obtained and filtered through a 25 micrometer screen, then placed in isotonic solution to obtain a concentration of about 10 percent, with the sample then being subjected to a Beckman Coulter Multisizer 3.

Additionally, the toners disclosed herein can possess low melting properties, thus these toners may be a low melt or ultra-low melt toner. The disclosed low melt toners display a melting point of from about 80° C. to about 130° C., or from about 90° C. to about 120° C., while the disclosed ultra-low melt toners display a melting point of from about 50° C. to about 100° C., and from about 55° C. to about 90° C.

Toner Additives

Any suitable surface additives may be selected for the disclosed toner compositions. Examples of additives are surface treated fumed silicas, such as for example TS-530® obtainable from Cabosil Corporation, with an 8 nanometer particle size and a surface treatment of hexamethyldisilazane; NAX50® silica, obtained from DeGussa/Nippon Aerosil Corporation, coated with HMDS; DTMS® silica, obtained from Cabot Corporation, comprised of a fumed silica silicon dioxide core L90 coated with DTMS; H2050EP®, obtained from Wacker Chemie, coated with an amino functionalized organopolysiloxane; metal oxides, such as $TiO_2$, like for example MT-3103®, available from Tayca Corporation, with a 16 nanometer particle size and a surface treatment of decylsilane; SMT5103®, obtainable from Tayca Corporation, comprised of a crystalline titanium dioxide core MT500B coated with DTMS; P-25®, obtainable from Degussa Chemicals, with no surface treatment; alternate metal oxides, such as aluminum oxide, and as a lubricating agent, for example, stearates or long chain alcohols, such as UNXLIN 700®, and the like. In general, silica is applied to the toner surface for toner flow, triboelectric enhancement, admix control, improved development and transfer stability, and higher toner blocking temperature. $TiO_2$ is applied for improved relative humidity (RH) stability, tribo control, and improved development, and transfer stability.

The surface additives silicon oxides and titanium oxides, which should more specifically possess, for example, a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET surface area, are applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume average particle diameter of the toner as measured in the standard Coulter Counter method, and that the additive particles are distributed as primary particles on the toner surface in a hexagonal closed packed structure. Another metric relating to the amount and size of the additives is the sum of the "SAC.times.Size" (surface area coverage multiplied by the primary particle size of the additive in nanometers) for each of the silica and titania particles, or the like, for which all of the additives should, more specifically, have a total SAC.times.Size range of, for example, about 4,500 to about 7,200. The ratio of the silica to titania particles is generally from about 50 percent silica/50 percent titania to about 85 percent silica/15 percent titania (on a weight percentage basis).

Calcium stearate and zinc stearate can also be selected as toner additives primarily providing for toner lubricating properties, developer conductivity and triboelectric charge enhancement, higher toner charge and charge stability by increasing the number of contacts between the toner and carrier particles. Examples of the stearates are SYNPRO®, Calcium Stearate 392A and SYNPRO®, Calcium Stearate NF Vegetable or Zinc Stearate-L. In embodiments, the toners contain from, for example, about 0.1 to about 5 weight percent titania, about 0.1 to about 8 weight percent silica, and optionally from about 0.1 to about 4 weight percent calcium or zinc stearate.

Shell Formation

An optional at least one shell of an amorphous polyester resin and an optional wax resin can be applied to the aggregated toner particles obtained in the form of a core by any desired or effective method. For example, the shell resin can be in the form of an emulsion that includes the disclosed amorphous polyester, wax, and a surfactant. The formed aggregated particles can be combined with the shell resin emulsion so that the shell resin forms a shell over from 80 to 100 percent of the formed aggregates.

Developer Compositions

Also encompassed by the present disclosure are developer compositions comprised of the toners illustrated herein and carrier particles. In embodiments, developer compositions comprise the disclosed toner particles mixed with carrier particles to form a two-component developer composition. In some embodiments, the toner concentration in the developer composition may range from about 1 weight percent to about 25 weight percent, such as from about 2 weight percent to about 15 weight percent, of the total weight of the developer composition.

Examples of carrier particles suitable for mixing with the disclosed toner compositions include those particles that are capable of triboelectrically obtaining a charge of opposite polarity to that of the toner particles, such as granular zircon, granular silicon, glass, steel, nickel, ferrites, iron ferrites, silicon dioxide, and the like. The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, such as a xerographic imaging system, the carrier core may be at least partially coated with a polymethyl methacrylate (PMMA) polymer having a weight-average molecular weight of 300,000 to 350,000, for example, such as commercially available from Soken. PMMA is an electropositive polymer that will generally impart a negative charge on the toner by contact therewith. The coating has, in embodiments, a coating weight of from about 0.1 weight percent to about 5 weight percent, or from about 0.5 weight percent to about 2 weight percent of the carrier. PMMA may optionally be copolymerized with any desired comonomer such that the resulting copolymer retains a suitable particle size. Suitable co-monomers for the copolymerization can include monoalkyl or dialkyl amines, such as dimethylaminoethyl methacrylates, diethylaminoethyl methacrylates, diisopropylaminoethyl methacrylates, tert-butyl amino ethyl methacrylates, mixtures thereof, and the like. The carrier particles may be prepared by mixing the carrier core with from about 0.05 weight percent to about 10 weight percent of polymer, such as from about 0.05 weight percent to about 3 weight percent of polymer, based on the weight of the coated carrier particles, until the polymer coating adheres to the carrier core by mechanical impaction and/or electrostatic attraction. Various effective suitable means can be used to apply the polymer to the surface of the carrier core particles, for example, cascade-roll mixing, tumbling, milling, shaking, electrostatic powder-cloud spraying, fluidized bed, electrostatic disc processing, and with an electrostatic curtain. The mixture of carrier core particles and polymer is then heated to melt and fuse the polymer to the carrier core particles. The coated carrier particles are then cooled and classified to a desired particle size.

Carrier particles can be mixed with toner particles in any suitable combination, such as for example, from about 1 to about 5 parts by weight of carrier particles are mixed with from about 10 to about 300 parts by weight of the toner particles.

The toner compositions disclosed may also include known charge additives in effective amounts, such as from about 0.1 to about 10 weight percent, or from 1 to about 5 weight percent, such as alkyl pyridinium halides, bisulfates, other suitable known charge control additives, and the like. Surface additives that can be added to the toner compositions after washing or drying include, for example, those disclosed herein, like metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374, and 3,983,045, the disclosures of which are totally incorporated herein by reference. Examples of specific suitable additives include zinc stearate and AEROSIL R972®, available from Degussa, in amounts of from about 0.1 to about 2 percent, which can be added during the aggregation process or blended into the formed toner products.

Additionally, the present disclosure provides a method of developing a latent xerographic image comprising applying the toner composition described herein to a photoconductor, transferring the developed image to a suitable substrate like paper, and fusing the toner composition to the substrate by exposing the toner composition to heat and pressure.

Specific embodiments will now be described in detail. These examples are intended to be illustrative, and are not limited to the materials, conditions, or process parameters set forth therein. All parts are percentages by solid weight unless otherwise indicated, and the particle sizes were measured with a Multisizer 3® Coulter Counter available from Beckman Coulter.

For the Examples that follow, the cohesion can be measured at various temperatures (51° C., 52° C., 53° C., 54° C., 55° C.), followed by plotting the cohesion value versus temperature. The temperature, where the cohesion is intercepted at 20 percent cohesion, is considered the toner blocking temperature.

Cohesion refers to the percent of toner that does not flow through sieve(s) after the prepared toners were maintained in an oven at certain temperatures, such as 51° C. The temperature can then be increased from 51° C. to 52° C., 53° C., and the like, and the cohesion values can be measured at each of these temperatures. The cohesion value (at each temperature) can then be plotted versus temperature, and the temperature at which the cohesion value is about 20 percent was determined to be the blocking temperature.

More specifically, 20 grams of the prepared toners illustrated herein, from about 5 to about 8 microns in average volume diameter, were blended with about 2 to about 4 percent of surface additives, such as silica and/or titania, and sieve blended through a 106 micron screen. A 10 gram sample of each of the toners were placed into separate aluminum weighing pans, and the samples were conditioned in a bench top environmental chamber at various temperatures (51° C., 52° C., 53° C., 54° C., 55° C., 56° C., 57° C.), and 50 percent RH for 24 hours. After 24 hours, the toner samples were removed and cooled in air for 30 minutes prior to the measurements.

Each of the cooled toner samples were transferred from the weighing pan to a 1,000 micron sieve at the top of the sieve stack (top (A) 1,000 microns, bottom (B) 106 microns). The difference in weight was measured, which difference provides the toner weight (m) transferred to the sieve stack. The sieve stack containing the toner sample was loaded into the holder of a Hosokawa flow tester apparatus. The tester was operated for 90 seconds with a 1 millimeter amplitude vibration. Once the flow tester times out, the weight of toner remaining on each sieve was measured, and the percent heat cohesion was calculated using 100*(A+B)/m, where A is the mass of toner remaining on the 1,000 micron screen, B is the mass of toner remaining on the 106 micron screen, and m is the total mass of the toner placed on top of the set of stacked screens. The cohesion obtained at each temperature was then plotted against the temperature, and the point at which 20 percent cohesion was interpolated (or extrapolated) from the plot corresponded to the blocking temperature.

Example I

To a 1 liter Buchi reactor equipped with a mechanical stirrer, bottom drain valve and distillation apparatus, there was charged propoxylated bisphenol A (433.8 grams, 53.25 percent by weight), terephthalic acid (109.4 grams, 23.4 percent by weight), dodecenyl succinic anhydride (DDSA) (100.5 grams, 16 percent by weight), trimellitic anhydride (9.5 grams, 2.33 percent by weight) and the catalyst FASCAT® 4100, a butylstannoic acid (2.5 grams), followed by heating to 230° C. over a two to three hour period, and maintained at for an additional 8 hours at 230° C. to 235° C. under nitrogen. During this time, water was collected in the distillation receiver. The resulting mixture was then heated at 225° C., and a vacuum was applied (2 to 3 millimeters-Hg) for 6 hours, after which an acid value of 4.19 milligrams/gram KOH was obtained with a softening point of 101.4° C. The obtained mixture was then heated at 190° C., and then there was added fumaric acid (16.7 grams, 3.9 percent by weight) and hydroquinone (0.5 gram), followed by heating to 203° C. over a 3 hour period, followed by applying a vacuum for another 3 hours until a softening point of 120.2° C. with an acid value of 14.2 milligrams/gram KOH was achieved. The reaction product of terpoly-(propoxylated bisphenol A-terephthalate)-terpoly-(propoxylated bisphenol A-dodecenylsuccinate)-terpoly-(propoxylated bisphenol A-fumarate)-(propoxylated bisphenol A-trimellitate) was then discharged into a container, and allowed to cool to room temperature, about 25° C.

An emulsion of the above prepared amorphous polyester resin was prepared by dissolving 100 grams of this resin in 100 grams of methyl ethyl ketone and 3 grams of isopropanol. The mixture obtained was then heated to 40° C. with stirring, and to this mixture were added dropwise 5.5 grams of ammonium hydroxide (10 percent aqueous solution), after which 200 grams of water were added dropwise over a 30 minute period. The resulting dispersion was then heated to 80° C., and the methyl ethyl ketone was removed by distillation to result in a 60.4 percent solid dispersion of the amorphous polyester resin in water. The amorphous polyester emulsion particles were measured by an electron microscope to be 155 nanometers in size diameter.

Examples II to IV

The Examples II to IV products of terpoly-(propoxylated bisphenol A-terephthalate)-terpoly-(propoxylated bisphenol A-dodecenylsuccinate)-terpoly-(propoxylated bisphenol A-fumarate)-(propoxylated bisphenol A-trimellitate) were individually prepared by repeating the processes of the above Example I with the amounts of DDSA shown in Table 2.

Comparative Resins A and B are available from Kao Corporation wherein Comparative Resin A is a terpoly-(propoxylated bisphenol A-terephthalate) terpoly-(propoxylated bisphenol A-dodecenylsuccinate) terpoly-(propoxylated bisphenol A-fumarate), and Comparative Resin B is terpoly-(propoxylated bisphenol A-terephthalate) terpoly-(propoxylated bisphenol A-dodecenylsuccinate)-terpoly-(ethoxylated bisphenol A-terephthalate) terpoly-(ethoxylated bisphenol A-dodecenylsuccinate)-terpoly-(propoxylated bisphenol A-trimellitate)-terpoly-(ethoxylated bisphenol A-trimellitate).

In Table 2 for the single resin properties, Tg is the glass transition temperature as measured by using the TA Instruments Q1000 Differential Scanning calorimeter in a temperature range of from 0° C. to 150° C. at a heating rate of 10° C. per minute under nitrogen flow. The acid value (AV) was measured by the ASTM D 974 method using 0.5 gram of the resin test material dissolved in THF with 2 to 3 drops of added phenolphthalein as indicator, and 0.1 N potassium hydroxide (KOH) in methanol as the titrant. The softening point (Ts) was measured using the Mettler Toledo FP83HT dropping point apparatus, and measured at an initial temperature of 100° C. and a 10° C./minute heating rate. The resin average volume particle size was measured by a Coulter Counter. $M_n$ and $M_w$ are the number average molecular weight and weight average molecular weight in thousands (4.3 equals 4,300), each as determined by GPC.

TABLE 2

| | DDSA | PROPERTIES | | | | |
|---|---|---|---|---|---|---|
| RESIN | Weight Percent | Tg ° C. | V mg KOH/g | Ts ° C. | $M_n$ /1000 g/mole | $M_w$ /1000 g/mole |
| COMPARATIVE RESIN A | 21.5 | 59.2 | 11.4 | 116 | 4.3 | 16.1 |
| COMPARATIVE RESIN B | 11.1 | 56.4 | 12.2 | 128 | 7.2 | 63.4 |

TABLE 2-continued

| RESIN | DDSA Weight Percent | PROPERTIES Tg ° C. | V mg KOH/g | Ts ° C. | $M_n$ /1000 g/mole | $M_w$ /1000 g/mole |
|---|---|---|---|---|---|---|
| 1:1 RATIO OF COMPARATIVE RESIN A AND B | 16.3 | 58-60 | 10-15 | 120-124 | 5.5-6.5 | 25-40 |
| EXAMPLE I | 16 | 60.5 | 14.2 | 120.2 | 7.1 | 25.9 |
| EXAMPLE II | 16 | 59.7 | 12.7 | 120.2 | 6.3 | 29.0 |
| EXAMPLE III | 12.8 | 61.9 | 13.6 | 121.5 | 6.6 | 28.7 |
| EXAMPLE IV | 9.5 | 61.1 | 10.2 | 119.8 | 5.9 | 27.4 |

Example V

There was prepared an emulsion that contains the crystalline resin CPE 10:9 as follows.

An aqueous emulsion of the crystalline polyester resin, poly(1,9-nonylene-succinate), obtained from DIC Chemicals, was prepared by dissolving 100 grams of this resin in ethyl acetate (600 grams). The resulting mixture was then added to 1 liter of water containing 2 grams of sodium bicarbonate, and homogenized for 20 minutes at 4,000 rpm, followed by heating to 80° C. to 85° C. to distill off the ethyl acetate. The resultant aqueous crystalline polyester emulsion had a solids content of 32.4 percent by weight and displayed a particle size of 155 nanometers.

Example VI

There was prepared an emulsion containing the crystalline polyester CPE 10:6 as follows:

An aqueous emulsion of the crystalline polyester resin, poly(1,6-hexylene-succinate) obtained from DIC Chemicals, was prepared by dissolving 100 grams of this resin in ethyl acetate (600 grams). The mixture obtained was then added to 1 liter of water containing 2 grams of sodium bicarbonate, and homogenized for 20 minutes at 4,000 rpm, followed by heating to 80° C. to 85° C. to distill off the ethyl acetate. The resultant aqueous crystalline polyester emulsion had a solids content of 35 percent by weight and displayed a particle size of 150 nanometers.

Example VII

Toner Preparation with 9 Weight Percent Wax

Into a 2 liter glass reactor equipped with an overhead mixer were added 100 grams of the emulsion containing the above Example I amorphous resin containing 60.4 grams of solids, 25 grams of the emulsion containing the above Example V crystalline resin emulsion containing 8.64 grams of solids, 36.12 grams of the wax dispersion polypropylene obtained as OMNOVA D1509® from IGI Chemicals, (30.65 weight percent solids), and 40.21 grams of the cyan pigment PB15:3 (17.89 weight percent). Separately, 2.15 grams of $Al_2(SO_4)_3$ (27.85 weight percent) were added as the flocculent under homogenization. The resulting mixture was heated to about 40° C. to aggregate the mixture particles while stirring with a magnetic stirrer at 250 rpm (revolutions per minute). The particle size was monitored with a Coulter Counter until the core particles reached a volume average particle size of about 4.6 μm (microns), and then the above prepared amorphous resin emulsion containing 33.6 grams of solids was added as a shell material, resulting in core-shell structured particles with an average particle size of about 5.6 microns. Thereafter, the pH of the resulting aggregated particles was increased to 8.5 by the addition of 4 weight percent of a sodium hydroxide (NaOH) solution followed by the addition of 4.62 grams of EDTA (39 weight percent) to freeze the toner particle growth. After freezing, the reaction mixture was heated to 85° C. to permit coalescence, resulting in a final toner particle size of about 6 microns in average volume diameter, and a circularity, as measured by the Sysmex FPIA 3000 analyzer available from Malvern Instruments, of about 0.970. The resulting coalesced particles were then cooled to room temperature, about 25° C., separated by sieving (25 millimeters), filtration, and then washed with water and freeze dried to provide the final toner particles.

Examples VIII to XIII

Toners were prepared by repeating the process of the above Example VII, with the exceptions that the amorphous resin, the crystalline resin, the DDSA, and the wax amounts and the properties thereof were as recited in the following Table 3.

TABLE 3

| TONER | AMORPHOUS RESIN | CRYSTALLINE RESIN | DDSA WEIGHT PERCENT | WAX (%) | P.S. (μm) | GSD (v/n) | CIRC. |
|---|---|---|---|---|---|---|---|
| EXAMPLE VII | EXAMPLE I | EXAMPLE V | 16 | 9 | 6.02 | 1.22/1.25 | 0.968 |
| EXAMPLE VIII | EXAMPLE I | EXAMPLE VI | 16 | 9 | 6.08 | 1.24/1.25 | 0.971 |
| EXAMPLE IX | EXAMPLE III | EXAMPLE VI | 12.8 | 9 | 6.08 | 1.24/1.25 | 0.969 |
| EXAMPLE X | EXAMPLE IV | EXAMPLE VI | 9.5 | 9 | 6.02 | 1.27/1.25 | 0.969 |
| EXAMPLE XI | EXAMPLE II | EXAMPLE VI | 16 | 4.5 | 5.96 | 1.22/1.24 | 0.970 |
| EXAMPLE XII | EXAMPLE III | EXAMPLE VI | 12.8 | 4.5 | 6.15 | 1.23/1.28 | 0.965 |
| EXAMPLE XIII | EXAMPLE IV | EXAMPLE VI | 9.5 | 4.5 | 6.55 | 1.30/1.28 | 0.970 |

Toner Cohesion (Blocking)

The following Table 4 toner blocking performances results were determined as disclosed herein, and where the control toner comprised of the amorphous single resin (16 weight percent DDSA) with the crystalline polyester CPE10:9 resulted in the blocking temperature shown, whereas both the toners with 16 weight percent DDSA resin and the lower cost crystalline polyester resin CPE 10:6 at 9 weight percent and 4.5 weight percent wax possessed poor blocking temperatures; with the lower cost crystalline polyester CPE 10:6, there resulted too much plasticization of the amorphous resin, and/or the inability of the CPE 10:6 to recrystallize from the amorphous resin. By utilizing the single amorphous resin with reduced DDSA content (12.8 and 9.5 weight percent), it was found that the toners with the lower cost CPE 10:6 crystalline resin had improved cohesion (blocking), indicating optimal plasticization at both 9 and 4.5 weight percent wax. The amorphous resins comprised of the lesser amounts of DDSA, are also expected to be lower in cost at about $0.20 to $0.25/Kg, and compared, for example, to the costs of Comparative Amorphous Resin B.

TABLE 4

| TONER BLOCKING PERFORMANCES | | | | | | |
|---|---|---|---|---|---|---|
| | CRYSTALLINE | DDSA | COHESION (%) | | | BLOCKING |
| TONER | RESIN | (%) | 51.9° C. | 53° C. | 54° C. | (° C.) |
| EXAMPLE VII | CPE 10:9 | 16 | 10.6, 9.6 | 13.8, 12.2 | 17.2, 22.1 | 53.7 |
| EXAMPLE VIII | CPE 10:6 | 16 | 91.5, 83.1 | | | <51.9 |
| EXAMPLE IX | CPE 10:6 | 12.8 | 11.5, 12.2 | 14.6, 13.6 | 23.2, 23.7 | 54.0 |
| EXAMPLE X | CPE 10:6 | 9.5 | 13.3, 10.9 | 22.4, 25.9 | 83.3, 78.9 | 52.7 |
| EXAMPLE XI | CPE 10:6 | 16 | 58.9, 53.9 | | | <51.9 |
| EXAMPLE XII | CPE 10:6 | 12.8 | 10.8, 15.2 | 28.3, 35.2 | 67.5, 76.5 | 52.5 |
| EXAMPLE XIII | CPE 10:6 | 9.5 | 12.2, 9.7 | 31.5, 28.3 | 70.7, 62.3 | 52.5 |

The toner of Table 4, Example VII, wherein the amorphous resin is comprised of 16 weight percent of DSA and with the crystalline polyester CPE 10:9 had a good blocking temperature of 53.7° C. For the toners of Examples VIII and XI, the blocking temperatures were relatively poor at <51.9° C. The toners of Examples IX, X, XII and XIII, wherein the lower cost CPE 10:6 resin was utilized with the amorphous resin comprised of 9.5 or 12.8 weight percent DSA, the blocking temperatures were very excellent at 52.5° C. or higher. These results indicate, for example, that the toners containing the lower cost crystalline polyester CPE 10:6 resin, together with the other components specified, such as the wax, and the amorphous polyester resin where the DDSA content was less than 16 weight percent and, for example, from 9.5 to 12.8 weight percent had improved blocking temperatures.

The fusing performance of the toners of Table 5 below, displayed good Cold and Hot-Offset, Crease MFT and Gloss compared to the commercially available similar Xerox 7000 toner that excludes a component selected from the group consisting of at least one of a dodecylsuccinic anhydride and a dodecylsuccinic acid, and wherein the amorphous polyester resin contains from about 8 weight percent to about 15.9 weight percent of this component or processes thereof.

It is believed that the Gloss level can be increased by the optimization of the amorphous polyester resin $M_n/M_w$.

TABLE 5

| TONER | CREASE MFT ° C. | COLD-OFFSET ° C. | HOT-OFFSET ° C. | GLOSS 50° C. |
|---|---|---|---|---|
| XEROX 7000 | 124 | 120 | 205 | 121 |
| EXAMPLE VII | 113 | 110 | 210 | 133 |

TABLE 5-continued

| TONER | CREASE MFT ° C. | COLD-OFFSET ° C. | HOT-OFFSET ° C. | GLOSS 50° C. |
|---|---|---|---|---|
| EXAMPLE VIII | 114 | 110 | 205 | 135 |
| EXAMPLE IX | 115 | 115 | 210 | 136 |
| EXAMPLE X | 115 | 110 | 210 | 137 |
| EXAMPLE XI | 114 | 110 | 210 | 130 |
| EXAMPLE XII | 119 | 115 | 210 | 140 |
| EXAMPLE XIII | 120 | 115 | 210 | 131 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A toner composition comprised of a core of a first amorphous polyester resin, a second crystalline polyester, a wax and a colorant, and at least one shell encasing said core, and which shell is comprised of said first amorphous polyester resin, and a wax, wherein said first amorphous polyester resin is prepared by the polycondensation of an organic diol, an organic diacid, a polycondensation catalyst and a dodecylsuccinic anhydride present in an amount of from about 9.5 weight percent to about 12.8 weight percent or a dodecylsuccinic acid present in an amount of from about 9.5 weight percent to about 12.8 weight percent, which preparation results in a terpoly(propoxylated bisphenol A co-dodecylsuccinate)-terpoly(propoxylated bisphenol A co-terephthalate)-terpoly-(propoxylated bisphenol A co-dodecylsuccinate), terpoly-(propoxylated bisphenol Aterephthalate)-terpoly-(propoxylated bisphenol A-dodecenylsuccinate)-terpoly-(propoxylated bisphenol Afumarate)-(propoxylated bisphenol A-trimellitate), or, terpoly (propoxylated bisphenol A-terephthalate)-terpoly (propoxylated bisphenol A-dodecenylsuccinate)-terpoly (propoxylated bisphenol A-fumarate), and wherein said crystalline polyester resin is selected from the group consisting of poly(1,6-hexylene-1,12-dodecanoate), poly(1,9-nonylene-succinate), and poly(1,6-hexylene-succinate).

2. A toner composition in accordance with claim 1 wherein said amorphous polyester is a terpoly(propoxylated bisphenol A co-dodecylsuccinate)-terpoly(propoxylated bisphenol A co-terephthalate)-terpoly-(propoxylated bisphenol A co-dodecylsuccinate) or, a terpoly-(propoxylated bisphenol A-terephthalate)-terpoly-(propoxylated bisphenol A-dodecenylsuccinate)-terpoly-(propoxylated bisphenol A-fumarate)-(propoxylated bisphenol A-trimellitate), the crystalline polyester is poly(1,6-hexylene-1,12-dodecanoate); the colorant is a pigment, and wherein at least one of said dodecylsuccinic anhydride and said dodecylsuccinic acid is dodecylsuccinic anhydride present in an amount of 9.5 weight percent, or, 12.8 weight percent.

3. A toner composition in accordance with claim 1 wherein said toner has a blocking temperature of from about 52° C. to about 55° C., said crystalline polyester is poly(1,6-hexylene-1,12-dodecanoate, said amorphous polyester is terpoly-(propoxylated bisphenol A-terephthalate)-terpoly-(propoxylated bisphenol A-dodecenylsuccinate)-terpoly-(propoxylated bisphenol A-fumarate)-(propoxylated bisphenol A-trimellitate), and which toner is prepared by emulsion/aggregation/coalescence processes.

4. A toner composition in accordance with claim 1 wherein said amorphous polyester is present in an amount of from about 70 weight percent to about 80 weight percent, said crystalline polyester resin is present in an amount of from about 5 weight percent to about 12 weight percent, said wax is present in an amount of from about 4 weight percent to about 9 weight percent, and said colorant is present in an amount of from about 3 weight percent to about 10 weight percent of the solids, and wherein said crystalline polyester is poly(1,6-hexylene-1,12-dodecanoate).

* * * * *